United States Patent [19]

Dalson

[11] Patent Number: 4,923,589

[45] Date of Patent: May 8, 1990

[54] PROCESS FOR REFORMING NEPHTHENE AND PARAFFIN-CONTAINING HYDROCARBONS IN THE NAPHTHA BOILING RANGE AND ISOMERIZING C5-C6 NORMAL PARAFFIN FEEDSTOCK TO PRODUCE A HIGH OCTANE GASOLINE

[75] Inventor: Milton H. Dalson, La Palma, Calif.

[73] Assignee: Atlantic Richfield Company, Los Angeles, Calif.

[21] Appl. No.: 42,071

[22] Filed: Apr. 24, 1987

[51] Int. Cl.[5] ..... C10G 35/04; C07C 5/13

[52] U.S. Cl. ..... 208/66; 208/64; 208/65; 585/734; 585/751

[58] Field of Search ..... 585/734, 751; 208/64, 208/65, 79, 66

[56] References Cited

U.S. PATENT DOCUMENTS

| | | | |
|---|---|---|---|
| 2,946,736 | 7/1960 | Muffet et al. | 208/65 |
| 3,018,244 | 1/1962 | Stanford et al. | 208/79 |
| 3,761,392 | 9/1973 | Pollock | 208/93 |
| 3,776,837 | 12/1973 | Dautzenberg et al. | 208/79 |
| 4,162,212 | 7/1979 | Miller | 208/79 |
| 4,181,599 | 1/1980 | Miller et al. | 208/79 |
| 4,457,832 | 7/1984 | Robinson | 208/66 |

*Primary Examiner*—Curtis R. Davis

*Attorney, Agent, or Firm*—Robert Berliner

[57] ABSTRACT

A combined reforming and isomerization process wherein at least a portion of the hydrogen produced in the reforming process is passed with a $C_5$–$C_6$ range normal paraffin feedstock to an isomerization zone, containing an isomerization catalyst, at isomerization condition to produce an isomerized $C_5$–$C_6$ product stream and passing the $C_5$–$C_6$ isomerized product stream to a reformate separation zone (hydrogen stripping and topping zones) and recovering at least a major portion of the isomerized $C_5$–$C_5$ product stream with the reformate for use as a high octane gasoline product.

8 Claims, 2 Drawing Sheets

Figure 1:
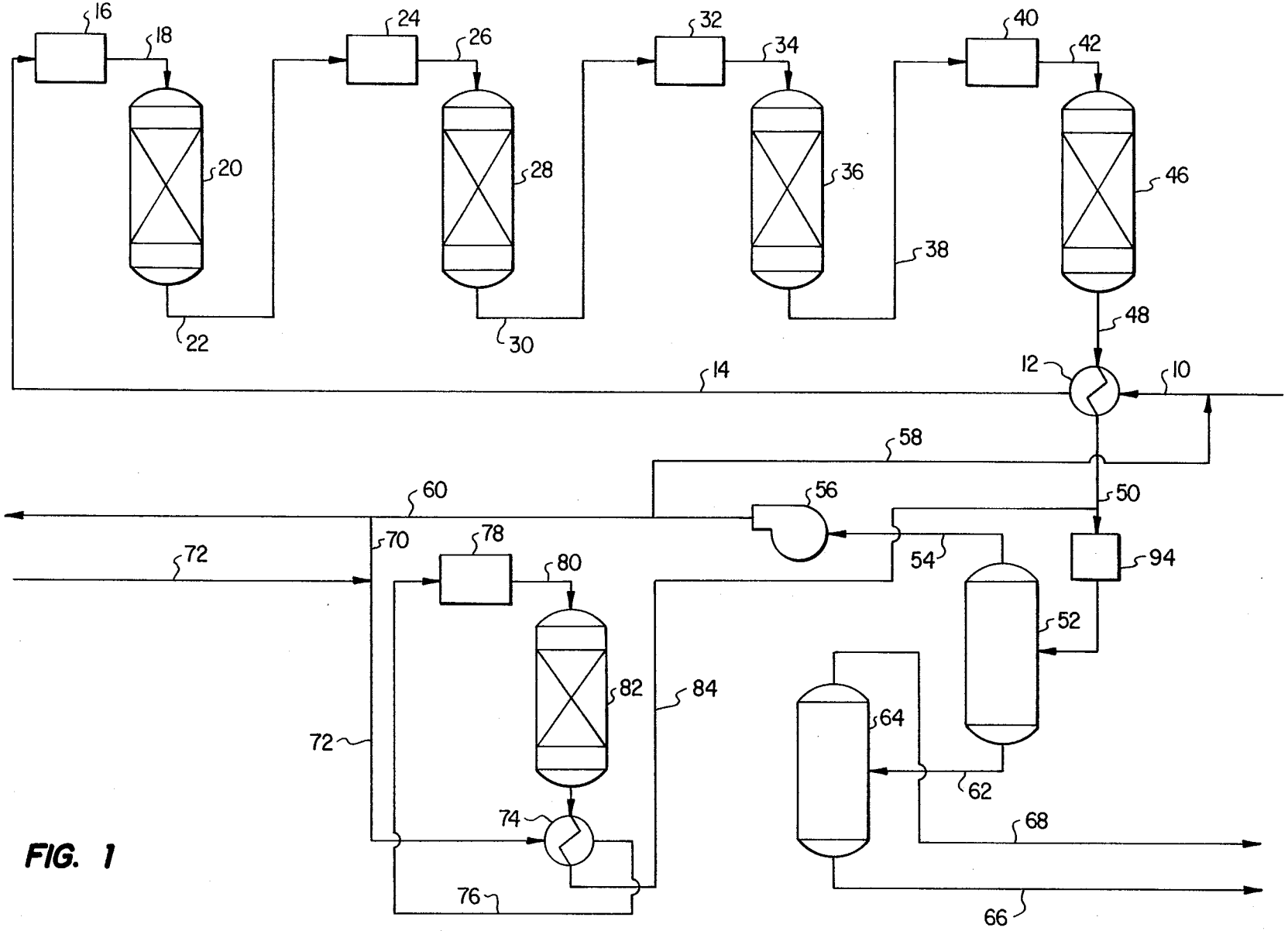

PROCESS FOR REFORMING NEPHTHENE AND PARAFFIN-CONTAINING HYDROCARBONS IN THE NAPHTHA BOILING RANGE AND ISOMERIZING C5-C6 NORMAL PARAFFIN FEEDSTOCK TO PRODUCE A HIGH OCTANE GASOLINE

This invention relates to a process for reforming naphthenic and paraffin-containing hydrocarbons and isomerizing $C_5$–$C_6$ normal paraffins to produce gasoline range products.

In refinery operations, it is desirable that a substantial portion of the crude oil or other petroleum feedstock to the refinery be converted to gasoline range materials. Gasoline comprises a hydrocarbon fraction generally having a boiling range from about 100° to about 430° F. and a research octane number (RON) of at least about 90. A variety of refinery processes are used to increase the gasoline yield from crude oil charged to a refinery. Such processes include catalytic cracking, reforming and the like. In the refining process, naphthenic and paraffin-containing hydrocarbons are produced which are of a suitable boiling range for use as gasoline, but which have an octane rating too low for such uses. The octane rating of such hydrocarbons is typically increased by reforming. In the reforming process, the naphthene hydrocarbons and paraffin hydrocarbons are converted to aromatic hydrocarbons. As well known to those skilled in the art, aromatic materials have a higher octane rating than similar boiling range paraffinic or naphthenic materials.

Typically, the naphthenic and paraffin-containing feedstock has a boiling range from about 200° to about 400° F. and contains at least about 15 volume percent naphthenes and at least about 25 volume percent paraffins. Such feedstocks may comprise straight run naphtha, hydrotreated naphtha, fluid cat cracker naphtha and the like. Such feedstocks are generally hydrotreated to desulfurize and denitrogenate the feedstock and treated to remove water and trace metals prior to charging the feedstock to the reforming process.

In such reforming processes, the naphthenes and paraffins are converted to aromatics in the presence of hydrogen in adiabatic fixed bed catalyst reaction zones to produce a reformate stream which typically has an aromatic content of at least about 50%. The term "aromatic" or "aromatics" as used herein refers to materials which contain at least one benzene ring structure. Such reforming processes are considered to be well known to those skilled in the art and involve the use of reforming catalysts which comprise supported platinum group metal reforming catalysts. Most commonly these catalysts comprise about 0.1 to about 2.0 weight percent platinum group metal component on an activated alumina base although other supports such as crystalline alumino silicate may be used. Such catalysts may also contain promoters such as about 1% chloride. These catalysts are generally considered to be slightly acidic catalysts and are considered to be known to those skilled in the art.

One such reforming process is disclosed in U.S. Pat. No. 3,392,107 entitled "Process for Reforminq Naphthene and Paraffin-Containing Hydrocarbons in the Naphtha Boiling Point Range in Several Stages to Obtain a High Octane Gasoline", issued July 9, 1968 to William C. Pfefferle, which is hereby incorporated in its entirety by reference. In this process, larger reforming vessels may be and preferably are used as the last reforming vessels in the process. The larger vessels receive a feedstock in which from about 75 to about 95% of the naphthenes have been converted to aromatics in combination with a hydrogen-containing recycled gas. In such processes, hydrogen is produced in the reforming reaction and there is frequently excess capacity in the equipment for heating and compressing the gas recycled to the larger reforming vessels and in the hydrogen stripping and reformate topping equipment. As a result, relatively expensive process equipment is frequently under utilized at least during periods of less than full capacity operation of the reforming process.

It has now been found that such excess capacity in the hydrogen heating and recycling equipment and in the reformate separation zone, i.e., the stripping and topping equipment, can be used to improve the yield of high octane gasoline from the process by an improvement whereby at least a portion of the hydrogen produced in the reforming process is mixed with a $C_5$–$C_6$ range normal paraffin feedstock and charged to an isomerization zone containing an isomerization catalyst and isomerized at isomerization conditions to produce an isomerized $C_5$–$C_6$ product stream which is then passed to the reformate separation zone where at least a major portion of the isomerized $C_5$–$C_6$ product is recovered with the reformate for use as a high octane gasoline product.

Figure 2:
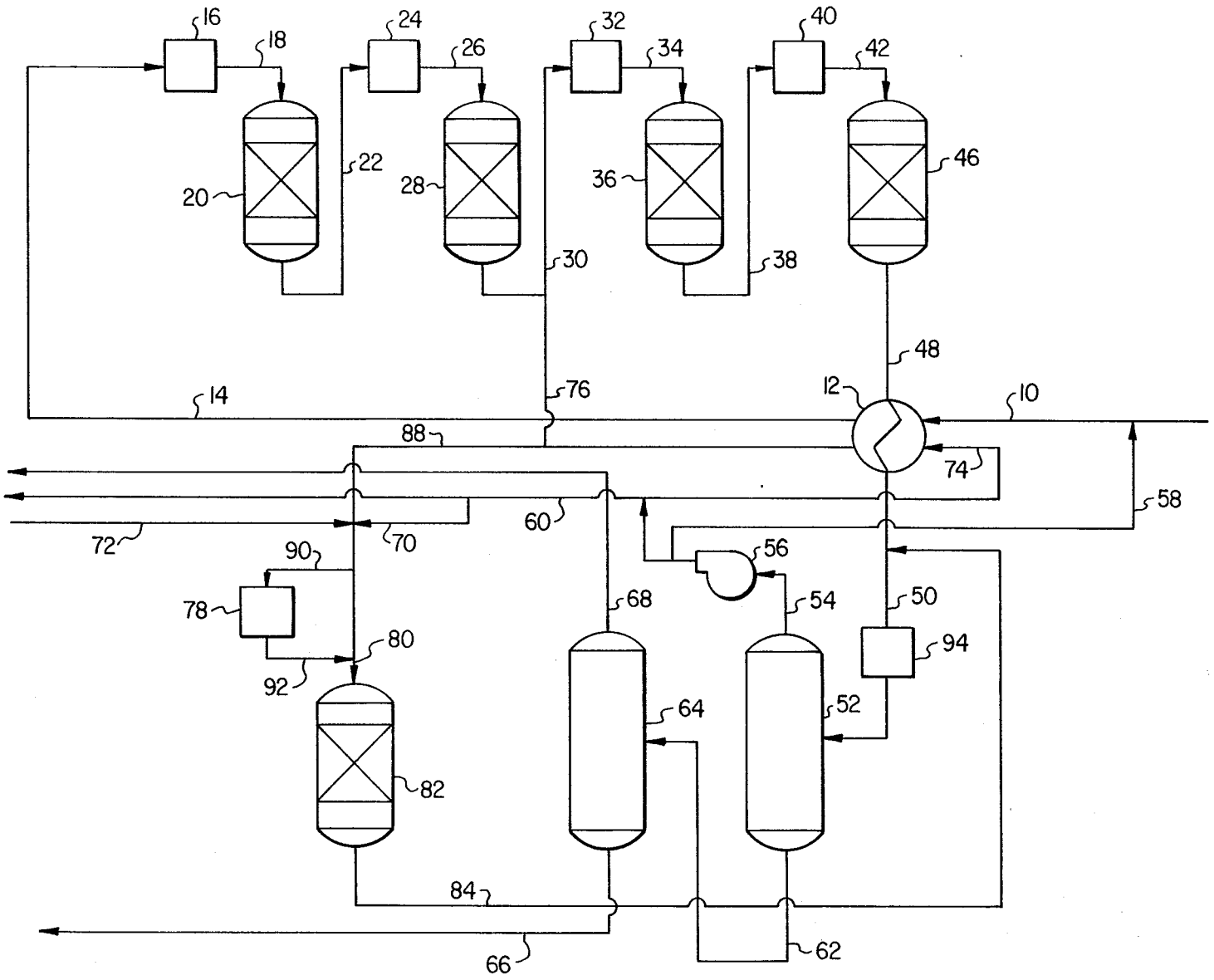

FIG. 1 is a schematic diagram of an embodiment of the present invention; and FIG. 2 is a schematic diagram of a further embodiment of the present invention.

In the discussion of the Figures, the same numbers will be used throughout to refer to the same or similar components. Various pumps, heat exchangers, valves and the like required to accomplish the indicated process steps have not been shown.

In FIG. 1, a feedstream containing naphthene and paraffin hydrocarbons is charged to a reforming process through a line 10. A hydrogen-containing stream, which during normal operations is produced in the reforming process, is supplied via a line 58 and mixed with the feedstream in line 10 to produce a mixture of hydrogen and feedstock which is passed to a heat exchanger 12. In heat exchanger 12, the mixture is heated by heat exchange with a product stream from the reforming process and thereafter passed through a line 14 to a heater 16 where the mixture is heated to a desired temperature and charged through a line 18 to a first reforming reactor 20. The reforming conditions are selected to produce a high octane gasoline product having a research octane number (RON) of at least about 90, and preferably, at least about 95. First reactor 20 contains a suitable reforming catalyst and typically is maintained at a pressure from about 100 to about 500 psig.

Suitable reforming catalysts are considered to be known to those skilled in the art and comprise supported platinum group metal reforming catalysts. Frequently such catalysts contain from about 0.1 to about 2.0 weight percent platinum group metal component on an activated alumina base, although other supports such as crystalline alumino-silicate or other suitable materials may be used. The catalysts may contain promoters. Suitable platinum group metals include platinum, rhodium, palladium and iridium. The catalysts may also contain about 1% chloride compounds and are generally considered to be slightly acidic catalysts.

The reaction in first reactor 20 is endothermic and the inlet temperature of the mixture, which is typically from about 820° to about 920° F., rapidly drops from about 50° to about 150° F. as a result of the endothermic reforming reaction in vessel 20. The reaction is relatively rapid and slows or stops after the reduced temperature is reached. The mixture is then passed from first reactor 20 through a line 22, a heater 24, and a line 26 to a second reforming reactor 28. The inlet temperature to second reactor 28 is typically about the same as the inlet temperature to first reactor 20. Since the mixture has at this point been partially reformed, the temperature drop in second reactor 28 may be somewhat less than in first reactor 20. The mixture leaving second reactor 28 passes through a line 30, a heater 32 and a line 34 to a third reforming reactor 36. The inlet temperature to third reactor 36 is generally about the same as for the preceding reactors but the reactions in third reactor 36 result in a still smaller temperature drop. The resulting mixture is passed from third reactor 36 through a line 38, a heater 40 and a line 42 to a fourth reforming reactor 46. The inlet temperature to fourth reactor 46 is generally about the same as for the preceding reactors but the temperature drop in reactor 46 is typically less than about 25° F.

In first reactor 20, the predominent reaction is the dehydrogenation of naphthenes to aromatics although some hydrocracking and dehydrocyclization of paraffins may occur. As the dehydrogenation of naphthenes becomes more complete, the reactions in the reactors become more predominately paraffin dehydrocyclization which is the predominent reaction in fourth reactor 46. As known to those skilled in the art, coke deposition is greatest and catalyst deactivation occur most rapidly in the last reactor i.e., reactor 46 where the catalyst is at the highest average temperature as a result of the smaller temperature drop in the last reactor.

The resulting reformate and hydrogen mixture is recovered from reactor 46 through a line 48 and passed through heat exchanger 12 to heat the incoming feed and hydrogen. The reformate and hydrogen from heat exchanger 12 are passed through a line 50 and a heat exchanger (cooler) 94 to a flash vessel 52 where the hydrogen and typically materials lighter than butane i.e., $C_4$ minus materials, are recovered through a line 54 and passed to a compresser 56 where the lighter materials are compressed for recycle through line 58 to mixture with the incoming feed in line 10 or recovery from the process as a product through a line 60. Reforming processes generate hydrogen as a product since the aromatics produced in the reforming process contain less hydrogen per atom of carbon than the naphthenes and paraffins charged to the process. The bottoms stream from flash vessel 52 is passed through a line 62 to a topping vessel 64 where the reformate is topped to produce a $C_5$ minus stream which is passed to further processing or other uses through a line 68 and a $C_5$ plus stream useful as a high octane gasoline which is recovered as a product through a line 66. This stream typically has an RON octane rating of at least about 90.

In the practice of the present invention, a portion of the hydrogen produced in the reforming process in removed from line 60 and passed through a line 70 to a line 72 where it is mixed with a $C_5$–$C_6$ normal (i.e., straight chain) paraffin stream and passed to an isomerization reactor 82. The mixture in line 72 is passed through a heat exchanger 74 and then through a line 76, a heater 78 and a line 80 into reactor 82. Reactor 82 contains a suitable isomerization catalyst for converting $C_5$ and $C_6$ paraffins into isomerized $C_5$ and $C_6$ hydrocarbons. Isomerized $C_5$ and $C_6$ paraffins have a higher octane rating than the corresponding normal paraffins and are suitable for blending with the reformate product.

Suitable isomerization catalysts include supported platinum group metal catalysts which may comprise from about 0.1 to about 2.0 weight percent platinum group metal component supported on activated alumina, crystalline aluminosilicate or other suitable support materials. The catalyst may also contain rhodium group metal components as well as promoters. Such catalysts may contain up to 20 weight percent acidic chloride components and are generally considered to be highly acidic catalysts. Such catalysts ar considered to be known to the art.

The mixture of hydrogen and feedstock is typically charged to vessel 82 at a temperature from about 275° to about 600° F. and a pressure from about 100 to about 600 pounds per square inch guage pressure (psig). Typically, isomerization processes using platinum on alumina catalyst promoted with chloride use temperatures from about 275° to about 350° F. and pressures from about 100 to about 500 psig, while isomerization processes using platinum on zeolite type catalysts use temperatures from about 500° to about 600° F. and pressures from about 100 to about 500 psig. The hydroqen is desirably supplied in an amount equal to from about 500 to about 4000 standard cubic feet per barrel of $C_5$–$C_6$ paraffin feedstock. The product stream from vessel 82 is recovered throuqh a line 84 and passed to combination with the reformate product in line 50 for treatment as discussed previously.

As noted previously, iso paraffins have a higher octane rating than the corresponding normal paraffins. Typically, the equilibrium mixture of normal and isomerized paraffins produced in such processes has a RON of about 80. The octane rating of the product stream can be increased in some instances to values of about 90 RON by the use of means, such as molecular sieve units, for separating the normal and isomerized paraffins. The isomerized paraffins can then be passed to the gasoline product stream and the normal paraffins can be recycled to the isomerization reactor. In the event that the feedstream to the isomerization reactor contains significant quantities of iso paraffins, a separation step can be used prior to charging the feedstream to the isomerization reactor. The use of such separation steps before, after or both before and after charging the paraffin feedstream to the isomerization reactor is considered to be known to those skilled in the art.

As known to those skilled in the art, it is not feasible to attempt to reform $C_5$ and $C_6$ range paraffins since these materials tend to crack rather than reform to aromatic materials in the reforming process. Clearly, $C_5$ hydrocarbons cannot be reformed to aromatic materials, which by definition include a ring comprising six carbon atoms. Normally $C_7$ and and higher materials are charged to the reforming process.

By the process of the present invention, the hydrogen stream available from the reforming process has been used to produce a high octane gasoline component from a low octane feedstream which is not readily converted to a high octane material by a reforming process. By the improvement of the present invention, hydrogen produced in the reforming process is available as a compressed stream which can be used to supply hydrogen for the isomerization process and the topping and stripping equipment used for the reforming process can be used to strip and top the products of the isomerization process as well. The required capacity may be designed into the stripping and topping units or it may be found that sufficient capacity exists in these units as a result of under utilization of the reforming process or a result of initial over design. In summary, the present improvement results in a combination of two processes previously used by the art to achieve a synergistic improvement in the production of a high octane gasoline.

In FIG. 2, an embodiment of the process shown in U.S. Pat. No. 3,392,107 is shown. Reactors 20 and 28 represent a naphtha dehydrogenation zone with reactors 36 and 46 representing a paraffin dehydrocyclization zone. It will be understood that more or fewer reactors could be used in each of the zones. As a result of the higher average temperatures in reactors in the paraffin dehydrocyclization zone, the catalyst in reactors 36 and 46 tends to degrade more rapidly than the catalyst in reactors 20 and 28 so that the catalyst life in reactors 36 and 46 is less than the life of the catalyst in reactors 20 and 28 even though most of the conversion of the naphthenes occurs in reactors 20 and 28. To combat this tendency, additional hydrogen is mixed with the feedstream (in which most of the naphthenes have been converted to aromatics) to the paraffin dehydrocyclization zone. The operation of the process in FIG. 2 is similar to that of FIG. 1, except that additional hydrogen is added to the mixture charged to reactor 36 via a line 76. The additional hydrogen is recovered from stripping vessel 52. The use of added amounts of hydrogen results in a reduced degradation of the catalyst in reactors 36 and 46. As a result, reactors 36 and 46 can operate at temperatures from about 900° to about 1000° F. Such an improvement is described more fully in U.S. Pat. No. 3,392,107. In FIG. 2, the hydrogen recovered from stripper vessel 52 is compressed in compressor 56 and split into a stream in a line 74 which is heated and recycled to reactors 36 and 46 via a line 76 and stream 58 which is generally at a higher pressure than the stream in line 74 and which is mixed with the feedstream to the reforming process in line 10. Portions of the stream in line 74 may be directed to the isomerization process via a line 88 and to recovery as a product via line 60 or optionally to the isomerization process via a line 70. As indicated previously, the streams in lines 58, 74 and 60 may also contain hydrocarbons generally lighter than $C_4$. Since heated high pressure hydrogen is available in this process (line 74), greater flexibility is available in the operation of the isomerization process than in the embodiment described in FIG. 1. For instance, compressed high temperature hydrogen can be supplied through a line 88 for mixture with $C_5$–$C_6$ paraffin feedstock charged to the isomerization process through line 72. It may or may not be necessary to further heat the resulting mixture in line 80 to accomplish the desired inlet temperature to isomerization reactor 82. If additional heating is necessary, the mixture can be passed through a line 90 to a heat exchanger 78 and returned via a line 92 to line 80 to adjust the temperature as required. Alternatively, compressed hydrogen prior to heating can be charged via a line 70 to mixture with the paraffin feed in line 72 with the resulting mixture being passed directly to line 80 or heated in heat exchanger 78, if necessary, and then passed to line 80. Such variations are known to those skilled in the art for temperature control in isomerization reactor 82. As discussed previously, the reactions in isomerization reactor 82 are considered to be known to those skilled in the art. The resulting isomerized $C_5$–$C_6$ product is recovered via line 84 and passed to combination with the mixture of reformate and hydrogen in line 50 for processing in stripping vessel 52 and topping vessel 64 to produce the desired gasoline range product.

As shown, the product stream in line 84 is combined with the product stream in line 50 and cooled in heat exchanger 94 prior to passing the product stream to stripping vessel 52. Stripping vessel 52 is a vessel for the separation of light gaseous components from the product streams from lines 50 and 84 and, typically, operates at a temperature below about 150° F. Accordingly, the temperature of both these streams must be adjusted to the desired temperature prior to charging them to vessel 52. Similar temperature adjustments are required to accomplish the desired separations in topping vessel 64. Since such temperature adjustments are readily achieved in a variety of ways known to the art, no further discussion of these details is deemed necessary.

In this embodiment of the process, since the high temperature, high pressure hydrogen is available as a process stream in the reforming process, the synergism between the isomerization process and the reforming process is greater than in the embodiment shown in FIG. 1. While important advantages are accomplished in the embodiment shown in FIG. 1, even greater efficiencies are accomplished in the process of the present invention as shown in FIG. 2 since heated high pressure hydrogen is available as part of the reforming process.

Neither reforming processes nor isomerization processes have been described in great detail since such processes are considered to be known to those skilled in the art. By the improvement of the present invention, these two processes which are known to the art for use in refinery operations for the production of a reformate product and for the production of an isomerized $C_5$–$C_6$ product have been combined in a synergistic manner to produce an increased quantity of high octane gasoline from a reforming process using existing equipment.

Having thus described the invention by reference to certain of its preferred embodiments, it is pointed out that the embodiments described are illustrative rather than limiting in nature and that many variations and modifications are possible within the scope of the present invention. Many such variations and modifications may appear obvious and desirable to those skilled in the art based upon a review of the foregoing description of preferred embodiments.

Having thus described the invention, I claim:

1. In a process for reforming a naphthenic and paraffin-containing hydrocarbon feedstock to produce a reformate product having an increased octane rating by contacting said feedstock with a reforming catalyst in the presence of hydrogen at reforming conditions in a reforming zone, said reforming zone including a naphtha dehydrogenation zone and a paraffin dehydrocyclization zone wherein heated, pressurized hydrogen is added to the effluent stream from said naphtha dehydrogenation zone prior to charging said effluent stream to said paraffin dehydrocyclization zone to produce a first product stream comprising a gasoline range reformate product having an RON octane rating of at least about 90 and hydrogen wherein said reformate product is separated from said hydrogen in a reformate separation zone, an improvement comprising: charging at least a portion of said heated, pressurized hydrogen with a $C_5$–$C_6$ n-paraffin feedstock to an isomerization zone containing an isomerization catalyst at isomerization conditions to produce a second product stream containing an isomerized $C_5$–$C_6$ product and passing said second product stream to said reformate separation zone and recovering at least a major portion of said isomerized $C_5$–$C_6$ product with said reformate product.

2. The improvement of claim 1 wherein said feedstock has a boiling range from about 200° to about 400° F.

3. The improvement of claim 1 wherein said isomerization conditions include a temperature from about 275° to about 600° F. and a pressure from about 100 to about 600 psig.

4. The improvement of claim 1 wherein said isomerized $C_5$–$C_6$ product has an RON octane rating of at least about 80.

5. The improvement of claim 1 wherein a portion of said hydrogen is heated and recycled directly to said paraffin dehydrocyclization zone.

6. A process for producing a gasoline range product having an RON octane of at least 90, said process consisting essentially of:

(a) charging a naphthene and paraffin containing hydrocarbon feedstock and hydrogen to a reforming zone said reforming zone including a naphtha dehydrogenation zone and a paraffin dehydrocyclization zone;

(b) reforming said naphthenic feedstock in said reforming zone in the presence of a reforming catalyst at reforming conditions to produce hydrogen and convert at least about 75% of said naphthenes to aromatics and produce a reformate product having an RON octane rating of at least 90 RON;

(c) adding heated, pressurized hydrogen at reforming temperature and pressure to the effluent stream from said naphtha dehydrogenation zone prior to charging said effluent stream to said paraffin dehydrocyclization zone;

(d) separating said reformate product from said hydrogen in a reformate separation zone;

(e) charging a $C_5$–$C_6$ n-paraffin feedstock and a portion of said heated, compressed hydrogen to an isomerization zone;

(f) isomerizing said $C_5$–$C_6$ n-paraffin feedstock in said isomerization zone in the presence of an isomerization catalyst at isomerization conditions to produce an isomerized $C_5$–$C_6$ product stream;

(g) charging said isomerized $C_5$–$C_6$ product stream to said reformate separation zone; and (h) recovering at least a major portion of said isomerized $C_5$–$C_6$ product stream with said reformate as said gasoline range product.

7. The process of claim 6 wherein said hydrocarbon feedstock has a boiling range from about 200° to about 400° F.

8. The process of claim 6 wherein said reformate separation zone includes a hydrogen and hydrocarbons lighter than butane removal section and a hydrocarbons lighter than pentane removal section.

* * * * *

UNITED STATES PATENT AND TRADEMARK OFFICE

CERTIFICATE OF CORRECTION

PATENT NO. : 4,923,589

DATED : May 8, 1990

INVENTOR(S) : Milton H. Dalson

It is certified that error appears in the above-identified patent and that said Letters Patent is hereby corrected as shown below:

On the cover page and in column 1, the first line of the title, delete "NEPHTHENE" and insert ---NAPHTHENE---

Signed and Sealed this

Twenty-eighth Day of May, 1991

*Attest:*

*Attesting Officer*

HARRY F. MANBECK, JR.

*Commissioner of Patents and Trademarks*